United States Patent [19]

Paul

[11] Patent Number: 4,907,892

[45] Date of Patent: Mar. 13, 1990

[54] METHOD AND APPARATUS FOR FILLING, BLENDING AND WITHDRAWING SOLID PARTICULATE MATERIAL FROM A VESSEL

[75] Inventor: Kermit D. Paul, Allentown, Pa.

[73] Assignee: Fuller Company, Lehigh Valley, Pa.

[21] Appl. No.: 305,029

[22] Filed: Feb. 2, 1989

[51] Int. Cl.[4] ..... B01F 13/02

[52] U.S. Cl. ..... 366/101; 366/3

[58] Field of Search ..... 366/101, 102, 103, 104, 366/105, 106, 107, 348, 9, 3, 5, 10, 11, 341; 34/57 A; 406/137

[56] References Cited

U.S. PATENT DOCUMENTS

| | | | |
|---|---|---|---|
| 3,158,362 | 11/1964 | Seifarth | 366/134 |
| 3,216,629 | 11/1965 | Goins | 366/191 |
| 3,276,753 | 10/1966 | Solt | 366/107 |
| 3,421,739 | 1/1969 | Alberts | 366/134 |
| 4,486,101 | 12/1984 | Brar | 366/101 |

*Primary Examiner*—Robert W. Jenkins
*Attorney, Agent, or Firm*—Daniel DeJoseph

[57] ABSTRACT

An apparatus and method are provided for blending solid particulate material. The invention employs equipment for enabling simultaneous drain and recycle, for selective top filling or bottom filling of the vessel, and for providing a bypass line for removing plugs which may form in the lift pipe. The apparatus includes a continuous blending unit which includes a sensor to measure the amount of material in the vessel by measuring its height or weight, and a controller, responsive to the sensor, for controlling the fresh particulate material feed rate and/or the material withdrawal rate so that the fresh material supply rate and the blended material withdrawal rate are proportioned to control the material level within the vessel to a desired level.

23 Claims, 3 Drawing Sheets

METHOD AND APPARATUS FOR FILLING, BLENDING AND WITHDRAWING SOLID PARTICULATE MATERIAL FROM A VESSEL

FIELD OF THE INVENTION

This invention relates to a material blending system which employs either a bottom or a top fill technique for solid particulate material, such as plastic pellets, and which employs a central lift or blending column.

BACKGROUND OF THE INVENTION

Material blenders are known which include a vertically oriented vessel with a centrally mounted lift column for recirculating material within the vessel. Typical examples of such blenders are shown, for example, in U.S. Pat. Nos. 3,276,753; 3,642,178; and 4,194,845.

Gravity type blenders include a vertically oriented vessel with a plurality of downcomers each having inlets at various levels in the vessel. Material in the upper part of the vessel enters the downcomers into a receiving bin or hopper so that material from various levels in the vessel are mixed. In some instances, a material recirculation system is provided. Typical examples of such blenders are shown for example in U.S. Pat. Nos. 3,158,362; 3,216,629; 3,421,739 and 4,068,828.

Bottom fill blenders include a central lift column for blending solid particulate material such as plastic pellets. Such apparatus are generally shown in U.S. Pat. No. 4,569,596 and U.S. patent application Ser. No. 680,213 filed Dec. 10, 1984, now U.S. Pat. No. 4,573,800, both assigned to the assignee of the present invention. In this type of system, the material to be blended is pneumatically conveyed from a source of material to the bottom of the blender and the energy utilized for conveying the material to the blender is used to lift the material up the central lift column entraining material already in the vessel lifting the same to the top of the vessel and, thereby, blending the material. Top fill techniques are also known in the art.

U.S. Pat. Nos. 4,068,828 and 3,592,446 disclose systems capable of continuous blending of particulate materials with particles being introduced at one location within a vessel and withdrawn at another location within the vessel at the same time.

SUMMARY OF THE INVENTION

It is a principal object of the present invention to provide a blending system having improved equipment located at the lower end of the seal leg which enables simultaneous fill, blend and discharge.

It is also an object of the present invention to provide a blending system having equipment located at the lower end of the seal leg for enabling simultaneous draining and recycle from the same seal leg, for selectively enabling top filling or bottom filling, and for providing a bypass line for removing plugs which may form in the lift pipe.

According to the invention, there is provided an apparatus for blending and withdrawing solid particulate material, which includes a vertically oriented vessel having an upper part, a lower part, and a tubular extension on the lower part, a vertical lift column (1) centrally mounted in the vessel, (2) having a lower part extending into the tubular extension, (3) having an inlet within the tubular extension, and (4) having an outlet in the upper part of the vessel, and a fluid supply/material drain means for (1) supplying gaseous fluid under pressure to the tubular extension below the lift column for entraining material in the tubular extension into the inlet of the lift column and upwardly of the lift column whereby material is discharged from the outlet of the lift column in a geyser-like manner into the upper part of the vessel and (2) withdrawing blended particulate material from the vessel. The fluid supply/material drain means comprises a nozzle means disposed within the tubular extension below the inlet of the lift column for receiving the gaseous fluid and directing it toward the lift column and a first valve means in fluid communication with the tubular extension for opening and closing to control withdrawal of blended particulate material from the tubular extension below the nozzle means. The first valve means when open enables simultaneous supply of gaseous fluid and withdrawal of blended particulate material.

The apparatus can further include a bypass line means, in fluid communication with the nozzle means and including a second valve means for opening and closing the bypass line means, for receiving the gaseous fluid from the nozzle means when the second valve means is open to remove plugs from the lift pipe. The bypass line means can be connected to the upper part of the vessel.

The apparatus can also include a source of fresh particulate material to be blended, which is connected to the means for supplying gaseous fluid to cause the gaseous fluid supplied to the tubular extension to include fresh particulate material and a material level measuring means for measuring an amount of particulate material contained in the vessel. The apparatus can further include a controller means, responsive to the material level measuring means, for controlling the first valve to cause a withdrawal rate of blended particulate material to be substantially equal to a feed rate of the fresh particulate material to be blended so as to cause the material level within the vessel to remain substantially constant. Alternatively, the controller means can control the means for supplying gaseous fluid to cause the feed rate of fresh particulate material to be substantially equal to the withdrawal rate of blended particulate material so as to cause the material level within the vessel to remain substantially constant. Also alternatively, the controller means can control at least one of the first valve means and the means for supplying gaseous fluid to cause the feed rate of fresh particulate material and the withdrawal rate of blended particulate material to be proportioned so as to control the material level within the vessel to a desired level.

The tubular extension and the lift column are dimensioned to define a seal leg to enable a major portion of the gaseous fluid to be directed upwardly through the lift column. The first valve means can be a rotary valve.

Also according to the invention, there is provided an apparatus for blending solid particulate material, which as an alternative to the above-described nozzle means and first valve means, includes a nozzle means connected to a lower end of the tubular extension below the inlet of the lift column for receiving the gaseous fluid and directing the gaseous fluid toward the lift column, a conduit means connected to the lower part of the vessel for conveying blended particulate material from the lower part of the vessel, and a valve means, connected to the conduit means, for opening and closing to control withdrawal of the blended particulate material through the conduit means.

Also according to the invention, there is provided a method for blending and withdrawing solid particulate material from an apparatus which includes a vertically oriented vessel having an upper part, a lower part and a tubular extension on the lower part, a vertical lift column centrally mounted in the vessel, having a lower part extending into the tubular extension, having an inlet within the tubular extension, and having an outlet in the upper part of the vessel, the method including: (1) supplying gaseous fluid under pressure to the tubular extension below the lift column to entrain material in the tubular extension into the inlet of the lift column and upwardly of the lift column, whereby material is discharged from the outlet of the lift column in a geyser-like manner into the upper part of the vessel; and (2) withdrawing blended particulate material from the tubular extension below the inlet of the lift column.

The method can further include bypassing the gaseous fluid away from the tubular extension to remove plugs which may develop in the lift column. The method can further include measuring an amount of particulate material contained in the vessel and controlling the withdrawal rate of blended particulate material to be substantially equal to a feed rate of fresh particulate material to be blended so as to cause the material level within the vessel to remain substantially constant. The method can alternatively include measuring the amount of particulate material contained in the vessel and controlling the feed rate of fresh particulate material to be substantially equal to the withdrawal rate of blended particulate material so as to cause the material level within the vessel to remain substantially constant. The method can further alternatively include measuring the amount of particulate material contained in the vessel and controlling at least one of the feed rate of fresh particulate material and the withdrawal rate of blended particulate material to be proportioned so as to control the material level within the vessel to a desired level.

BRIEF DESCRIPTION OF THE DRAWINGS

The above and other objects, advantages and features of the invention will be more fully understood when considered in conjunction with the following discussion and the attached drawings, of which.

DESCRIPTION OF THE PREFERRED EMBODIMENTS

Figure 1:
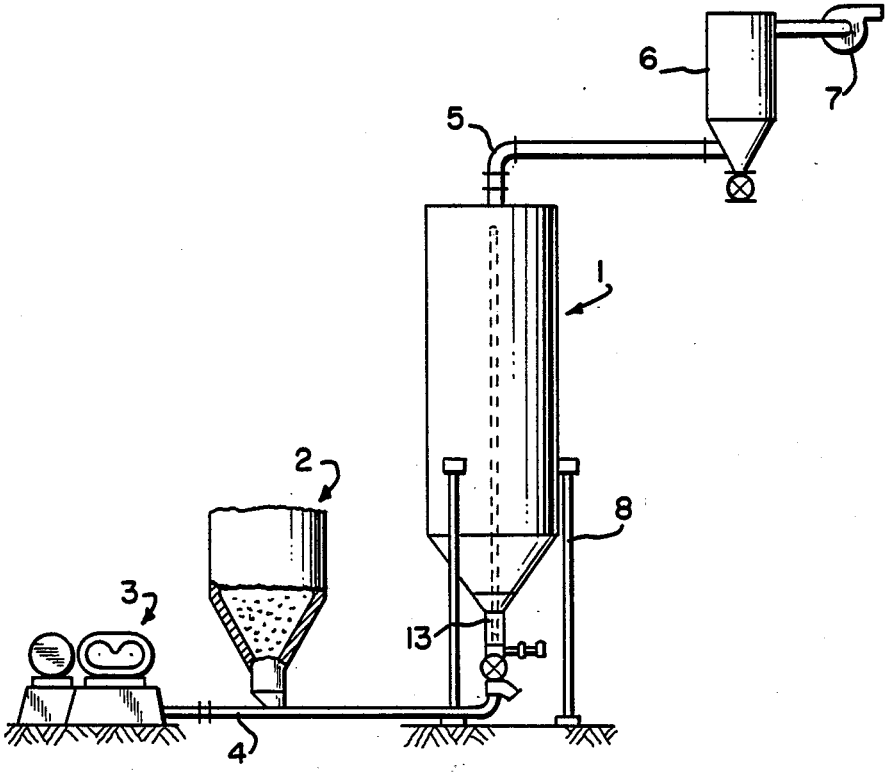
FIG. 1 is a diagrammatic view of the blending system according to the present invention.

Referring to FIG. 1, the blending system according to the present invention includes a blender generally indicated at 1, a source of particulate material to be blended indicated at 2 and a source of gaseous fluid under pressure such as a motor operated blower 3. A conduit 4 extends between blower 3 and inlet 13 of blender 1 for supplying gaseous fluid under pressure and entrained fresh material to be blended from source 2 to blender 1. Material from source 2 is supplied to conduit 4 by any of the several means known in the pneumatic conveying art. A similar system is disclosed in U.S. Pat. No. 4,569,596.

Figure 2:
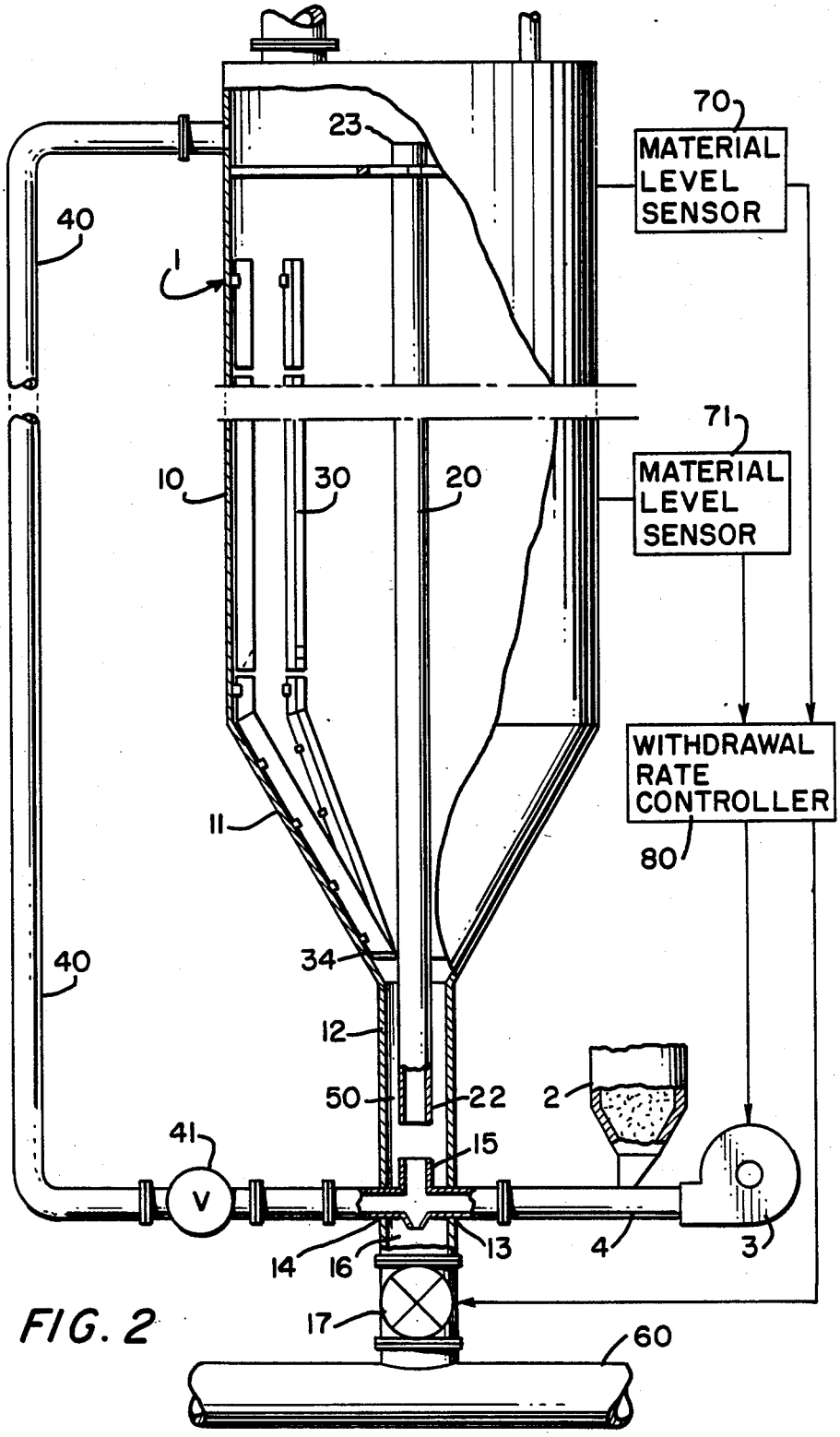
FIG. 2 is a sectional view of a first embodiment of the blending apparatus according to the present invention.

Referring to FIG. 2, blender 1 includes a vertically oriented vessel 10 having a hopper shaped bottom or lower end 11 and a downwardly extending tubular extension 12 centrally positioned in the lower part of vessel 10. Conduit 4 extends into tubular extension 12 at hole 13 and passes through extension 12 at hole 14. The invention includes a bottom inlet in the form of a T-shaped nozzle including upper nozzle portion 15 for directing gaseous fluid which may include material to be blended toward lift column 20 and a lower nozzle portion 16 for draining material from the nozzle during a draining mode when the flow of gas from blower 3 has been shut off. The invention also includes bypass line 40 for the purpose of clearing plugs from lift column 20. Upper nozzle portion 15 extends upwardly from conduit 4 within extension 12, and lower nozzle portion 16 extends downwardly from conduit 4 within the same. Nozzle portions 15 and 16 are positioned vertically below lower end 22 of lift column 20. Tubular extension 12 has an inner diameter greater than the outer diameters of lower end 22 of column 20 and of nozzle portions 15 and 16. Rotary valve 17 is disposed below the lower end of tubular extension 12 and is operable to withdraw material from tubular extension 12 to conveying line 60.

Air bypass line 40 is connected to the port of conduit 4 projecting from tubular extension 12 and functions to remove plugs that may form in lift column 20. Such plugs may develop if air from blower 3 is reduced in pressure and the blending air does not have sufficient pressure to break the plugs. If valve 41 on bypass line 40 is opened fully to enable bypass of the blower air or material is withdrawn from the blender via the opening of rotary valve 17, material will move out of lift column 20 first to discharge the plug. Observation through a sight glass in the tubular extension 12 shows that material is again moving through seal leg 50, thus indicating that lift column 20 is free of the plug and blending air can again be supplied to blender 1 by shutting off bypass valve 41. Bypass line 40 thus provides the capability of mid-fill cycle restarting. When it is desired to supply material to blending vessel 10, material is supplied from source 2 by entrainment in the gaseous fluid under pressure supplied from blower 3 and conveyed through line 4 into tubular extension 12 and then into lift column 20.

Vessel 10 includes a vertically oriented, centrally mounted blending or lift column 20 which extends downwardly into tubular section 12 as illustrated in FIG. 2. This blending column or lift column 20 is mounted in the vessel 10 by means of support brackets (not shown). Column 20 is hollow and open ended and has a lower end 22 positioned above nozzle 15 within tubular extension 12 and an upper end or outlet 23 which is near the top of vessel 10.

During operation of the blender according to the present invention, material is supplied from source 2 through conveying line 4 and the energy used to supply material to blending vessel 10 also conveys material up lift column 20 where it spills out of top outlet 23 of column 20 in a geyser-like manner into the top of vessel 10. Material which is in the vessel fills tubular extension 12 and is entrained in the gaseous fluid under pressure conveying fresh material from source 2 whereby the material already in vessel 10 is also conveyed up lift column 20 to thereby blend material already in vessel 10 with fresh material being supplied to vessel 10. Of course, if there is no fresh material being supplied through conduit 4, air under pressure is supplied through conduit 4 up through column 20 to entrain material already in vessel 10 up through column 20 to circulate material through vessel 10 to achieve blending.

According to the invention, continuous blending can be achieved via simultaneous drain, fill and recycle from the same seal leg 50. The invention can also operate in modes of simultaneous drain and fill, drain and recycle, and fill and recycle. Also, the apparatus can run in single mode operation, i.e., with only drain, fill or recycle occurring at any particular time. While blending air is being supplied from blower 3, with or without particles from source 2 entrained therein, to seal leg 50 of blender 1 for direction into central lift column 20 to entrain particulate material in vessel 10 up through lift column 20 for blending action, rotary valve 17 can be opened to withdraw material from below tubular extension 12 to conveying line 60.

A material level measuring means, such as sensors 70 and 71, are provided to measure the amount of material in the vessel. It should be noted that this measuring means can be, for example, a material height sensor or a weight sensor. A controller 80 receives the output from the level measuring means and controls the speed of rotary valve 17 so that the material feed rate to blender 1 corresponds substantially to the material withdrawal rate from binder 1. For example, if the material level drops below a given low level, the withdrawal rate can be reduced by decreasing the speed of rotation of rotary valve 17, and, if the material level exceeds a given high level, the withdrawal rate can be increased by increasing the speed of rotation of rotary valve 17. Continuous blending is achieved by circulating some of the material from seal leg 50 up through lift column 20 while the balance of the material is discharged through rotary valve 17 to conveying line 60. Alternatively, the feed rate at which fresh material is fed via line 4 can be controlled to correspond to the withdrawal rate so as to maintain the feed rate and the withdrawal rate substantially equal. It should be noted, also, that the feed rate and the withdrawal rate can be controlled as desired to vary the material level within vessel 10 as desired.

Figure 3:
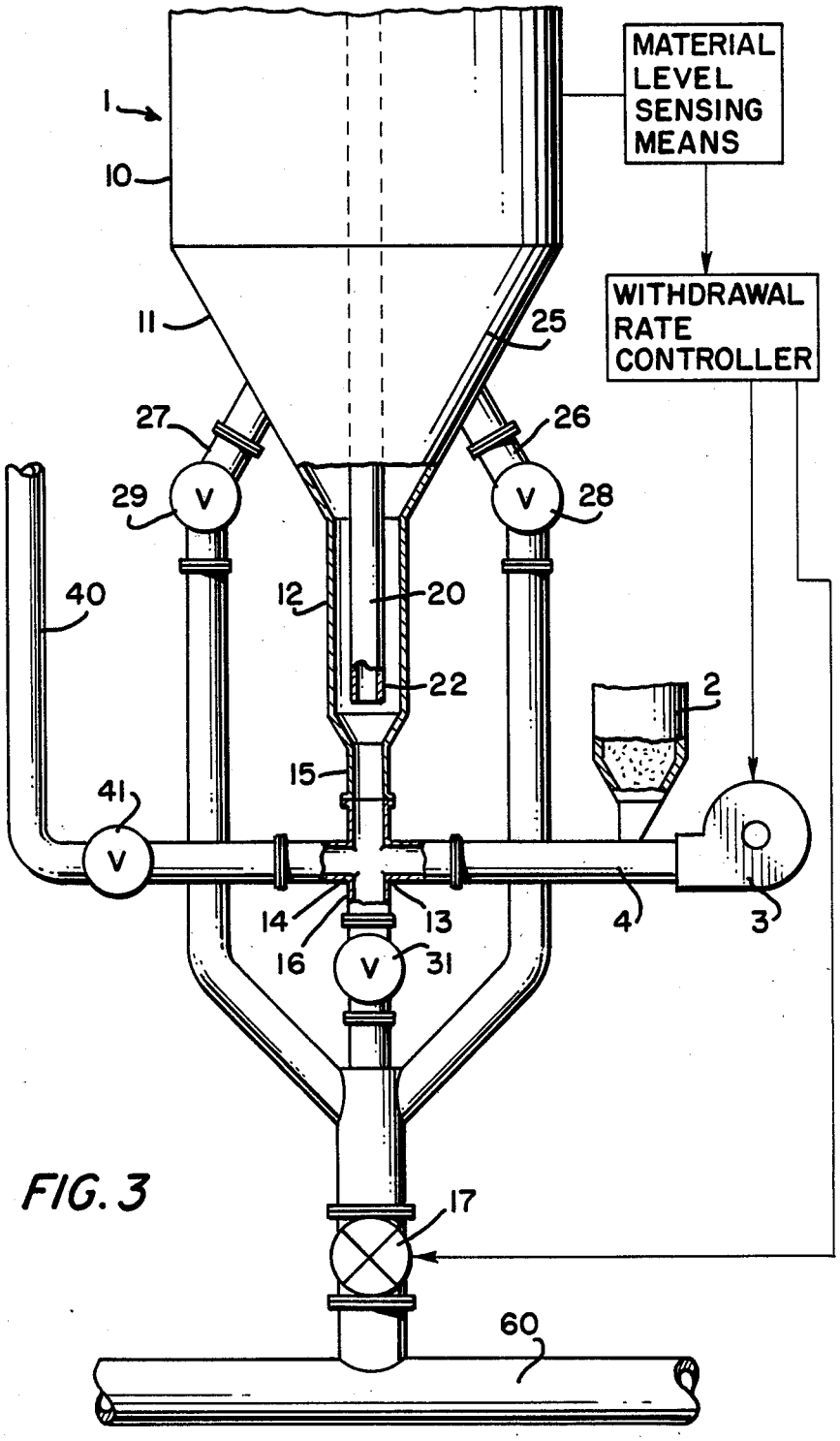
FIG. 3 is a sectional view of a second embodiment of the apparatus according to the present invention.

FIG. 3 shows a modified embodiment in which material is withdrawn via lines 26 and 27 from bottom 25 of blending vessel 10 rather than through seal leg 50. In this embodiment, upper nozzle portion 15 connects the bottom portion of tubular extension 12 instead of being positioned within extension 12 as in FIG. 12. Lower nozzle portion 16 connects to a line containing a valve 31. When valve 31 is open, material from the bottom region of seal leg 50 can pass downwardly toward rotary valve 17.

From the foregoing, it should be apparent that the objects of this invention have been achieved. An improved blending system is provided which enables continuous blending by simultaneous draining and recycling from the same seal leg, which provides for alternate top filling or bottom filling, and which provides a bypass line to remove plugs from the lift column and provide for mid-fill cycle restarting. The invention provides an improved system for continuous blending by employing a material level sensing means for sensing the material level in the blender vessel and a controller which, in response to the output of the sensing means, controls one or both of the feed rate or the withdrawal rate. The energy used to supply material to the vessel through conduit 4 is also used to blend the fresh material with material already in the vessel.

It should be noted that the above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. An apparatus for blending and withdrawing solid particulate material, comprising:

a vertically oriented vessel having an upper part, a lower part and a tubular extension on said lower part;

a vertical lift column (i) centrally mounted in said vessel, (ii) having a lower part extending into said tubular extension, (iii) having an inlet within said tubular extension, and (iv) having an outlet in the upper part of said vessel;

fluid supply/material drain means for (i) supplying gaseous fluid under pressure to said tubular extension below said lift column for entraining material in said tubular extension into said inlet of said lift column and upwardly of said lift column, whereby material is discharged from said outlet of said lift column in a geyser-like manner into said upper part of said vessel and (ii) withdrawing blended particulate material from said vessel, said fluid supply/-material drain means comprising nozzle means disposed within said tubular extension below said inlet of said lift column for receiving said gaseous fluid and directing said gaseous fluid toward said lift column and a first valve means in fluid communication with said tubular extension below said nozzle means for opening and closing to control withdrawal of blended particulate material from said tubular extension below said nozzle means, said first valve means when open enabling simultaneous supply of gaseous fluid and withdrawal of blended particulate material.

2. The apparatus as in claim 1, further comprising bypass line means, in fluid communication with said nozzle means and including a second valve means for opening and closing said bypass line means, for receiving said gaseous fluid from said nozzle means when said second valve means is open to remove plugs from said lift column.

3. The apparatus as in claim 2, wherein said bypass line means is connected to said upper part of said vessel.

4. The apparatus as in claim 1, further comprising a source of fresh particulate material to be blended, said source being connected to said means for supplying gaseous fluid to cause said gaseous fluid supplied to said tubular extension to include fresh particulate material, and a material level measuring means for measuring an amount of particulate material contained in said vessel.

5. The apparatus as in claim 4, further comprising a controller means, responsive to said material level measuring means, for controlling said first valve means to cause a withdrawal rate of blended particulate material to be substantially equal to a feed rate of said fresh particulate material to be blended so as to cause said material level within said vessel to remain substantially constant.

6. The apparatus as in claim 4, further comprising a controller means, responsive to said material level measuring means, for controlling said means for supplying gaseous fluid to cause a feed rate of fresh particulate material to be substantially equal to a withdrawal rate of blended particulate material so as to cause said material level within said vessel to remain substantially constant.

7. The apparatus as in claim 4, further comprising a controller means, responsive to said material level measuring means, for controlling at least one of said first valve means and said means for supplying gaseous fluid to cause a feed rate of fresh particulate material and a withdrawal rate of blended particulate material to be proportioned so as to control said material level within said vessel to a desired level.

8. The apparatus as in claim 1, wherein said first valve means is a rotary valve.

9. The apparatus as in claim 1, wherein said tubular extension and said lift column are dimensioned to define a seal leg to enable a major portion of said gaseous fluid to be directed upwardly through said lift column.

10. An apparatus for blending solid particulate material, comprising:

a vertically oriented vessel having an upper part, a lower part and a tubular extension on said lower part;

a vertical lift column (i) centrally mounted in said vessel, (ii) having a lower part extending into said tubular extension, (iii) having an inlet within said tubular extension and (iv) having an outlet in the upper part of said vessel;

fluid supply/material drain means for (i) supplying gaseous fluid under pressure to said tubular extension below said lift column for entraining material in said tubular extension into said inlet of said lift column and upwardly of said lift column whereby material is discharged from said outlet of said lift column in a geyser-like manner into said upper part of said vessel and (ii) withdrawing blended particulate material from said vessel, said fluid supply/-material drain means comprising a nozzle means connected to a lower end of said tubular extension below said inlet of said lift column for receiving said gaseous fluid and directing said gaseous fluid toward said lift column, a conduit means connected to said lower part of said vessel for conveying blended particulate material from said lower part of said vessel, and a first valve means, connected to said conduit means, for opening and closing to control withdrawal of said blended particulate material through said conduit means, said first valve means when open enabling simultaneous supply of said gaseous fluid and withdrawal of said blended particulate material.

11. The apparatus as in claim 10, further comprising bypass line means, in fluid communication with said nozzle means and including a second valve means for opening and closing said bypass line means, for receiving said gaseous fluid from said nozzle means when said second valve means is open to remove plugs from said lift column.

12. The apparatus as in claim 11, wherein said bypass line means is connected to said upper part of said vessel.

13. The apparatus as in claim 10, further comprising a source of fresh particulate material to be blended, said source being connected to said means for supplying gaseous fluid to cause said gaseous fluid supplied to said tubular extension to include fresh particulate material and a material level measuring means for measuring an amount of particulate material contained in said vessel.

14. The apparatus as in claim 13, further comprising a controller means, responsive to said material level measuring means, for controlling said first valve means to cause a withdrawal rate of blended particulate material to be substantially equal to a feed rate of said fresh particulate material to be blended so as to cause said material level within said vessel to remain substantially constant.

15. The apparatus as in claim 13, further comprising a controller means, responsive to said material level measuring means, for controlling said means for supplying gaseous fluid to cause a feed rate of fresh particulate material to be substantially equal to a withdrawal rate of blended particulate material to cause said material level within said vessel to remain substantially constant.

16. The apparatus as in claim 13, further comprising a controller means, responsive to said material level measuring means, for controlling at least one of said first valve means and said means for supplying gaseous fluid to cause a feed rate of fresh particulate material and a withdrawal rate of blended particulate material to be proportioned so as to control said material level within said vessel to a desired level.

17. The apparatus as in claim 10, wherein said first valve means is a rotary valve.

18. The apparatus as in claim 10, wherein said tubular extension and said lift column are dimensioned to define a seal leg to enable a major portion of said gaseous fluid to be directed upwardly through said lift column.

19. A method for blending and withdrawing solid particulate material from an apparatus which includes a vertically oriented vessel having an upper part, a lower part and a tubular extension on said lower part, and a vertical lift column centrally mounted in said vessel, having a lower part extending into said tubular extension, having an inlet for said solid particulate material within said tubular extension, and having an outlet in the upper part of said vessel, said method comprising:

supplying gaseous fluid under pressure to said tubular extension below said lift column to entrain material in said tubular extension into said inlet of said lift column and upwardly of said lift column, whereby material is discharged from said outlet of said lift column in a geyser-like manner into said upper part of said vessel; and withdrawing blended particulate material from said tubular extension below said inlet of said lift column.

20. The method as in claim 19, further comprising bypassing said gaseous fluid away from said tubular extension to remove plugs from said lift column.

21. The method as in claim 19, further comprising measuring an amount of particulate material contained in said vessel, and controlling a withdrawal rate of blended particulate material to be substantially equal to a feed rate of said fresh particulate material to be blended so as to cause said material level within said vessel to remain substantially constant.

22. The method as in claim 19, further comprising measuring an amount of particulate material contained in said vessel, and controlling a feed rate of fresh particulate material to be substantially equal to a withdrawal rate of blended particulate material so as to cause said material level within said vessel to remain substantially constant.

23. The method as in claim 19, further comprising measuring an amount of particulate material contained in said vessel, and controlling at least one of a feed rate of fresh particulate material and a withdrawal rate of blended particulate material to be proportioned so as to control said material level within said vessel to a desired level.

* * * * *